US005884385A

United States Patent [19]

Quintile

[11] Patent Number: 5,884,385

[45] Date of Patent: Mar. 23, 1999

[54] METHOD OF MANUFACTURE AND FORMATION OF METAL MATTRESS FOUNDATION CORNER GUARDS

[75] Inventor: Mark J. Quintile, Brunswick, Ohio

[73] Assignee: Ohio Mattress Company Licensing and Components Group, Cleveland, Ohio

[21] Appl. No.: 854,696

[22] Filed: May 12, 1997

[51] Int. Cl.[6] ..... B21D 39/00

[52] U.S. Cl. ..... 29/513; 5/663; 5/739; 72/379.2

[58] Field of Search ..... 5/193, 279.1, 280, 5/286, 663, 907, 254, 260, 246; 267/80; 29/897, 897.1, 513, 525.01; 72/379.2

[56] References Cited

U.S. PATENT DOCUMENTS

| | | | |
|---|---|---|---|
| D. 235,957 | 7/1975 | Mills et al. . | |
| 2,330,756 | 9/1943 | Stanger | 29/513 |
| 2,951,252 | 9/1960 | Roche . | |
| 2,996,790 | 8/1961 | Trafford | 29/513 |
| 3,030,728 | 4/1962 | Wesman . | |
| 3,041,775 | 7/1962 | Brown Jr. et al. . | |
| 3,144,204 | 8/1964 | Bohanon | 29/513 |
| 3,302,221 | 2/1967 | Zysman | 29/513 |
| 3,406,411 | 10/1968 | Reis . | |
| 3,546,725 | 12/1970 | Tambascio . | |
| 3,710,405 | 1/1973 | Watts . | |
| 3,717,886 | 2/1973 | Watts . | |
| 3,725,188 | 4/1973 | Kalt . | |
| 3,738,259 | 6/1973 | Hochstatter . | |
| 4,251,308 | 2/1981 | Miller . | |
| 4,740,034 | 4/1988 | Snyder et al. . | |
| 5,005,237 | 4/1991 | Luchonok . | |
| 5,158,432 | 10/1992 | Cox | 29/513 |
| 5,265,291 | 11/1993 | Callaway . | |
| 5,628,080 | 5/1997 | Quintile | 5/663 |

*Primary Examiner*—David P. Bryant
*Attorney, Agent, or Firm*—Calfee, Halter & Griswold LLP

[57] ABSTRACT

A method of manufacture and formation of mattress foundation corner guards made of formable metal, including the steps of manufacturing guards in a flat planar configuration with attachment tabs extending from a bottom edge of the sidewall and in the same plane as the sidewall, and forming the guard about the rounded corner of a mattress foundation by positioning the sidewall of the guard at a midpoint of a radiused corner of intersecting side walls of a mattress foundation and the bending the side wall to generally conform to the radiused vertical wall of the mattress foundation corner, whereupon the corner guard side wall remains in a curved configuration which generally conforms to the radiused corner, and bending the attachment tabs about a bottom edge of the mattress foundation to lie flush against a bottom surface of the mattress foundation, and fastening the attachment tabs to the bottom of the foundation.

5 Claims, 4 Drawing Sheets

METHOD OF MANUFACTURE AND FORMATION OF METAL MATTRESS FOUNDATION CORNER GUARDS

FIELD OF THE INVENTION

The present invention relates generally to methods of forming corner guards for the rounded exterior corners of mattress foundations and, in particular, to methods of manually forming metal corner guards to the rounded exterior corners of mattress foundations.

BACKGROUND OF THE INVENTION

Corner guards are commonly attached to the lower exterior rounded corners of mattress foundations or "box springs", to protect the fabric which covers the foundation and foundation frame. Such corner guards typically extend in two dimensions about each corner; over a small area of the vertical side of the curved corner of the foundation, and over a small area of the flat bottom of the foundation adjacent the corner. Foundation corner guards have heretofore been made only of flexible plastic material, molded with a generally flat sidewall and attachment tabs which extend perpendicularly from the side wall, as shown in FIG. 1. Flexible plastic corner guards are installed upon the foundation by wrapping or bending the flat sidewall around the curved vertical wall at the bottom edge of the corner, and attaching the tabs which extend perpendicularly from the vertical wall against the underside of the foundation by fasteners driven through the tabs. In plastic corner guards of this type, it is only the attachment of the tabs to the underside of the frame at the corner that retains the vertical wall in the curved configuration. When the tabs are detached by breakage or failure of one or more of the fasteners, the vertical wall readily returns to an unbent, flat shape or is completely detached.

Other disadvantages of plastic corner guards and the associated methods of manufacture and attachment are the difficulties of getting the flat piece to tightly conform to the curved vertical wall surface of the foundation corners, and the resultant sloppy appearance of an ill fit. The perpendicular foundation of the attachment tabs are the only support to keep the vertical wall upright and are structurally inadequate to withstand forces applied to the top edge of the curved upright wall of the guard. Therefore, the curved wall of the guard is easily deflected away from the corner. Even guards which appear to conform to the curve of the corner at the factory can be easily detached, broken or warped due to inherent weakness of the material and by the post-molding bending, or as a result of detachment or loosening of a fastener. This frequently occurs during shipping and handling. Because plastic guards then immediately deform from the curved corner of the foundation, the foundation cannot be placed into a supporting bed frame without crushing and further deforming the guard. Also, the required bending precludes application of any type of coating or finish to the exterior of the guard which would crack when the guard is bent around the curved corner.

SUMMARY OF THE PRESENT INVENTION

The present invention overcomes these and other disadvantages of the prior art by providing a method of manufacturing and forming a metal corner guard which tightly conforms to the curved corners of a mattress foundation and has vastly superior structural strength.

In accordance with the invention, a metal mattress foundation corner guard is formed in a completely flat configuration with a sidewall and attachment tabs extending from a bottom edge of the side wall in the same plane as the sidewall. The sidewall of the corner guard is positioned against a rounded corner at an intersection of vertical walls of a mattress foundation and formed into a curve which corresponds to the corner of the mattress foundation. The attachment tabs are then bent about a bottom edge of the foundation to lie flat against the bottom of the foundation. Fasteners are used to secure the attachment tabs to the bottom of the foundation.

In accordance with another aspect of the invention, a method of manufacturing and forming a mattress foundation corner guard of metal, configured for attachment to a bottom edge of a rounded corner of a mattress foundation is described. The method includes the steps of cutting a corner guard out of a flat piece of metal, the corner guard having a sidewall with an interior side and an exterior side and top and bottom edges, and attachment tabs which extend from the bottom edge of the sidewall in the same plane as the sidewall; forming the sidewall in a curve which corresponds to a rounded corner of a mattress foundation to which the corner guard is to be attached, and bending the attachment tabs relative to the sidewall to extend perpendicular to the interior side of the sidewall.

And in accordance with another aspect of the invention, a method of forming a mattress foundation corner guard of metal and configured to be attached to a rounded corner of a mattress foundation having a vertical wall and a generally flat bottom includes the steps of cutting from a generally flat piece of metal a corner guard form having a sidewall and attachment tabs which extend from an edge of the sidewall and in the same plane as the sidewall, forming a curve in the sidewall which generally conforms to a rounded corner of a mattress foundation to which the corner guard is to be attached, and forming the attachment tabs to extend generally perpendicularly from the sidewall.

These and other aspects of the invention will become apparent to those skilled in the art upon the reading and understanding of the following detailed description made with reference to the annexed drawings in which like reference numerals refer to like parts.

DETAILED DESCRIPTION OF THE INVENTION

Figure 1:
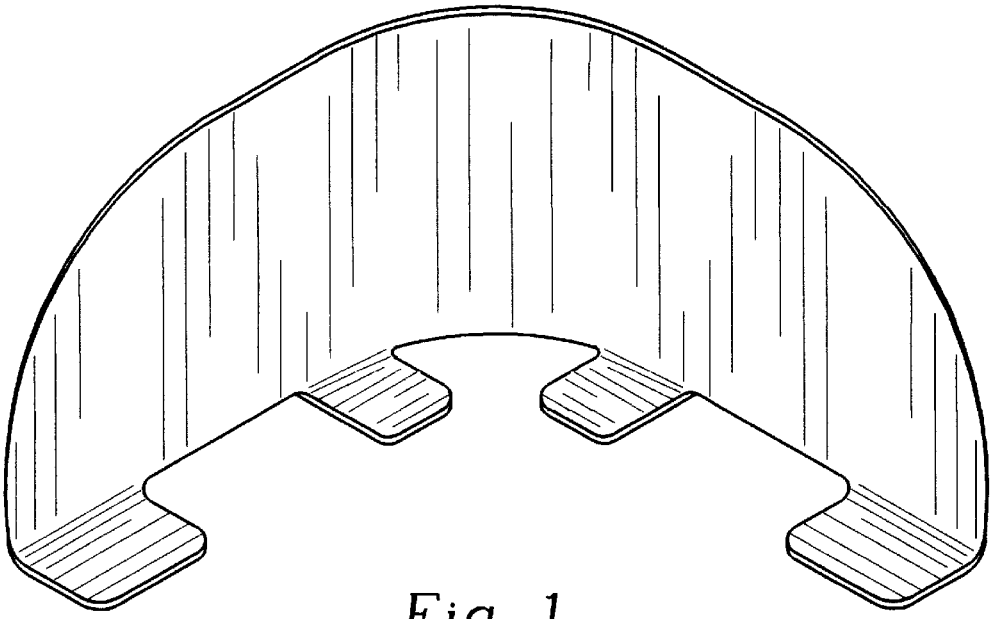
Fig. 1 PRIOR ART
FIG. 1 is a perspective view of a molded plastic corner guard of the prior art.
Figure 2:
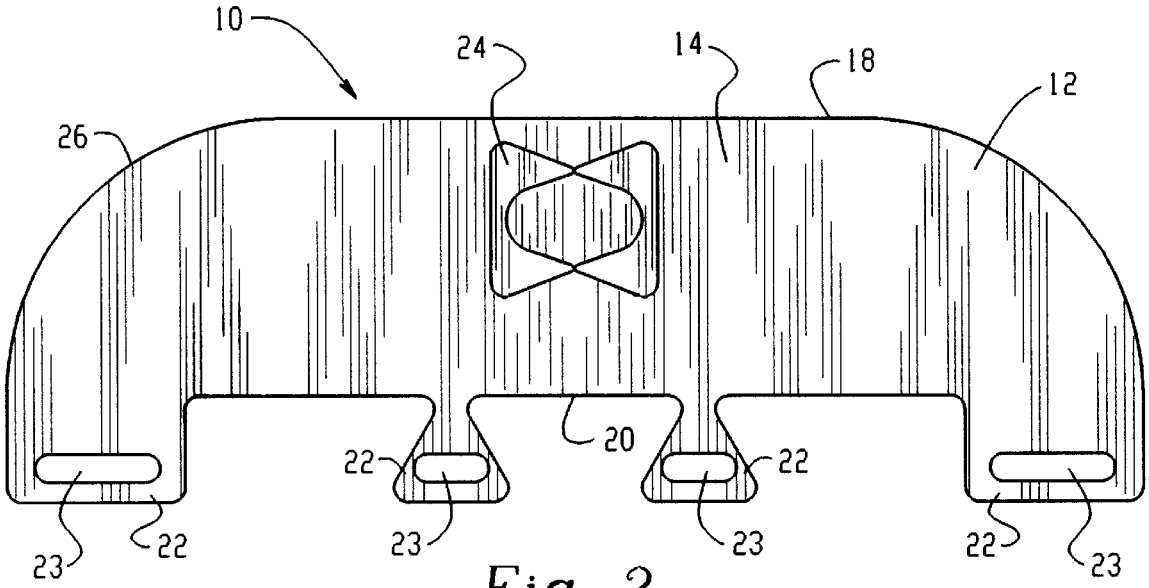
FIG. 2 is a front plan view of a metal mattress foundation corner guard of the present invention in the initial completely flat, planar configuration.

As shown in FIG. 2, a metal mattress foundation corner guard 10 of the present invention is stamped or cut or otherwise formed in a completely flat, planar configuration. The method of manufacture aspect of the invention is the initial production of the guard in a completely flat configuration. This is completely different from and counter-intuitive to the prior art practice of molding the attachment tabs perpendicular to the sidewall. Metal corner guard 10 is formed in a flat configuration and is preferably made of cold-rolled steel, commercial bright or any other manually or tool-pliable metal. As used herein, the term "metal" includes all such materials and materials which take a fixed set or shape when bent or formed. The guard 10 can also be made of aluminum, copper or pre-plated metal. Corner guard 10 includes a sidewall 12, an outer surface 14, an inner surface 16, an upper edge 18, a lower edge 20 and attachment tabs 22. In a preferred embodiment, sidewall 12 has a thickness of approximately 1 mm, a length of approximately 20 cm and a height of approximately 5 cm., although any other suitable dimensions are contemplated. Outer surface 14 may include raised relief areas 24 which can have a thickness greater than a thickness of sidewall 12 and may be formed in the shape of indicia such as letters or numerals representing, for example, trade names and/or trade marks as may be incorporated in the stamping production of the corner guards. Hand or machine finishing or buffing can highlight the relief areas. Upper edge 18 of sidewall 12 may include curved corners 26 near the ends of sidewall 12. Attachment tabs 22 are formed at lower edge 20 to extend in the same plane as the sidewall 12. Attachment tabs 22 may be formed to a length of, for example, approximately 2 cm and a width of, for example, approximately 2 to 3 cm. As shown, the width of the tabs positioned at or near the ends of sidewall 12 may be greater than the width of the tabs located inward to increase the structural and attachment strength of the tabs. Each tab may be provided with a through hole 28 to allow for attachment of the corner guard to a foundation frame by staple, screw or nail or any type of suitable fastener. Adhesive attachment is also possible.

Figure 3A:
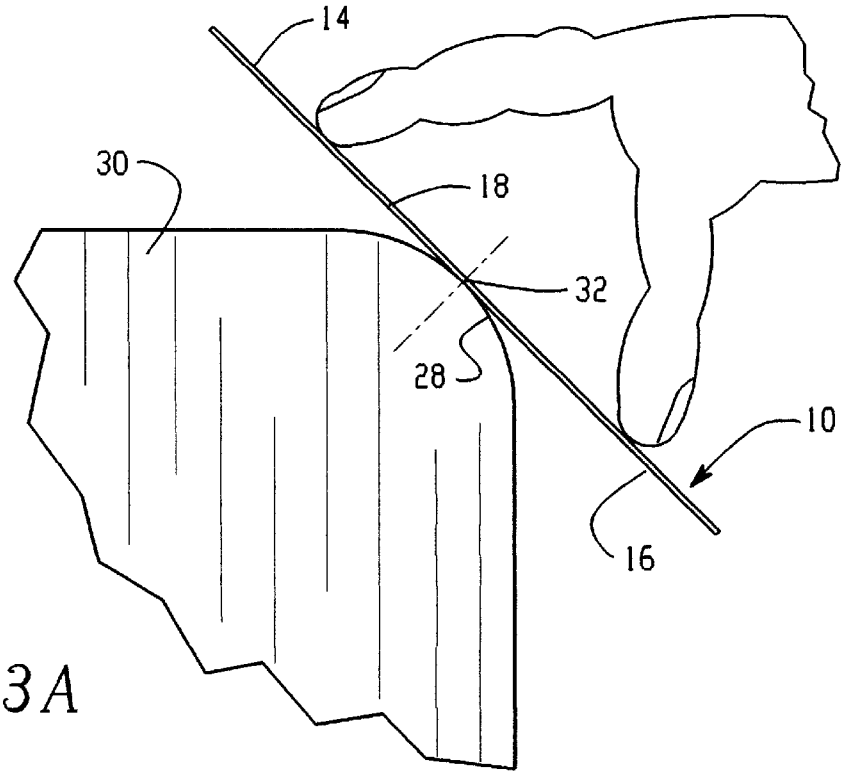
FIG. 3A is a top view of a metal mattress foundation corner guard of the present invention being formed to a rounded corner of a mattress foundation in accordance with the method of the present invention.
Figure 3B:
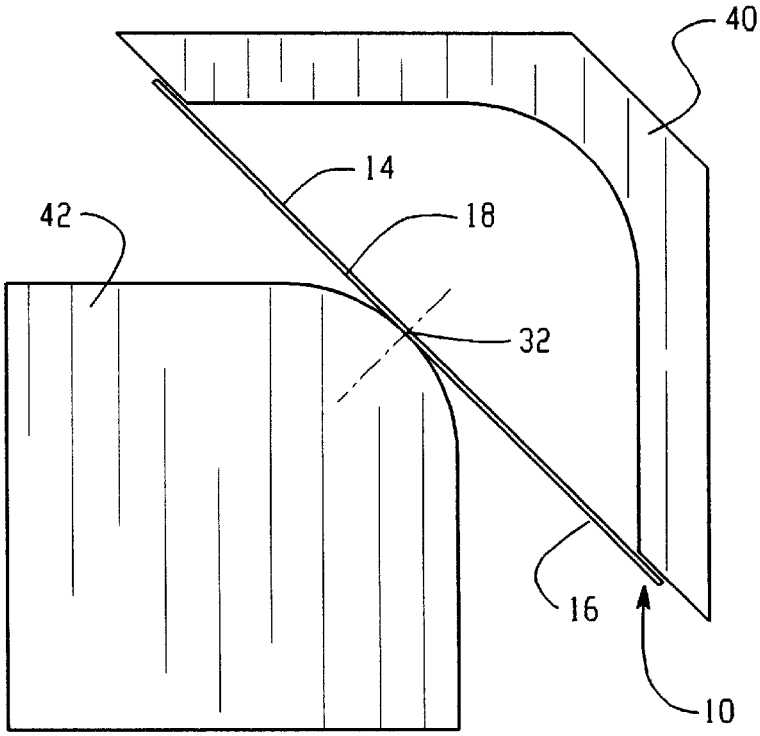
FIG. 3B is a top view of a metal mattress foundation corner guard of the present invention being formed to a rounded corner of a mattress foundation in accordance with the method of the present invention.

The method of corner guard formation aspect of the invention is performed as shown in FIG. 3 by positioning an inner surface 16 of sidewall 12 against a rounded corner 28 of mattress foundation 30 so that midpoint 32 of sidewall 12 is aligned with an approximate radial midpoint of rounded corner 28. Sidewall 12 is then formed or bent by hand or by any suitable tool against rounded corner 28 to take on a curved configuration having a radius of curvature approximately equal to the radius of curvature of rounded corner 28. Because the corner guard 10 is made of malleable and formable metal, once bent into the curved configuration it retains this shape through permanent deformation of the material structure. Thus, even in the event that some of the attachment tabs fail or become detached from the foundation, so long as the guard remains even partially secured to the foundation it will generally conform to the rounded corner thereof, and the foundation can still be positioned within a supporting frame without first repairing the guard. This is particularly advantageous over the prior art as described above.

Figure 4:
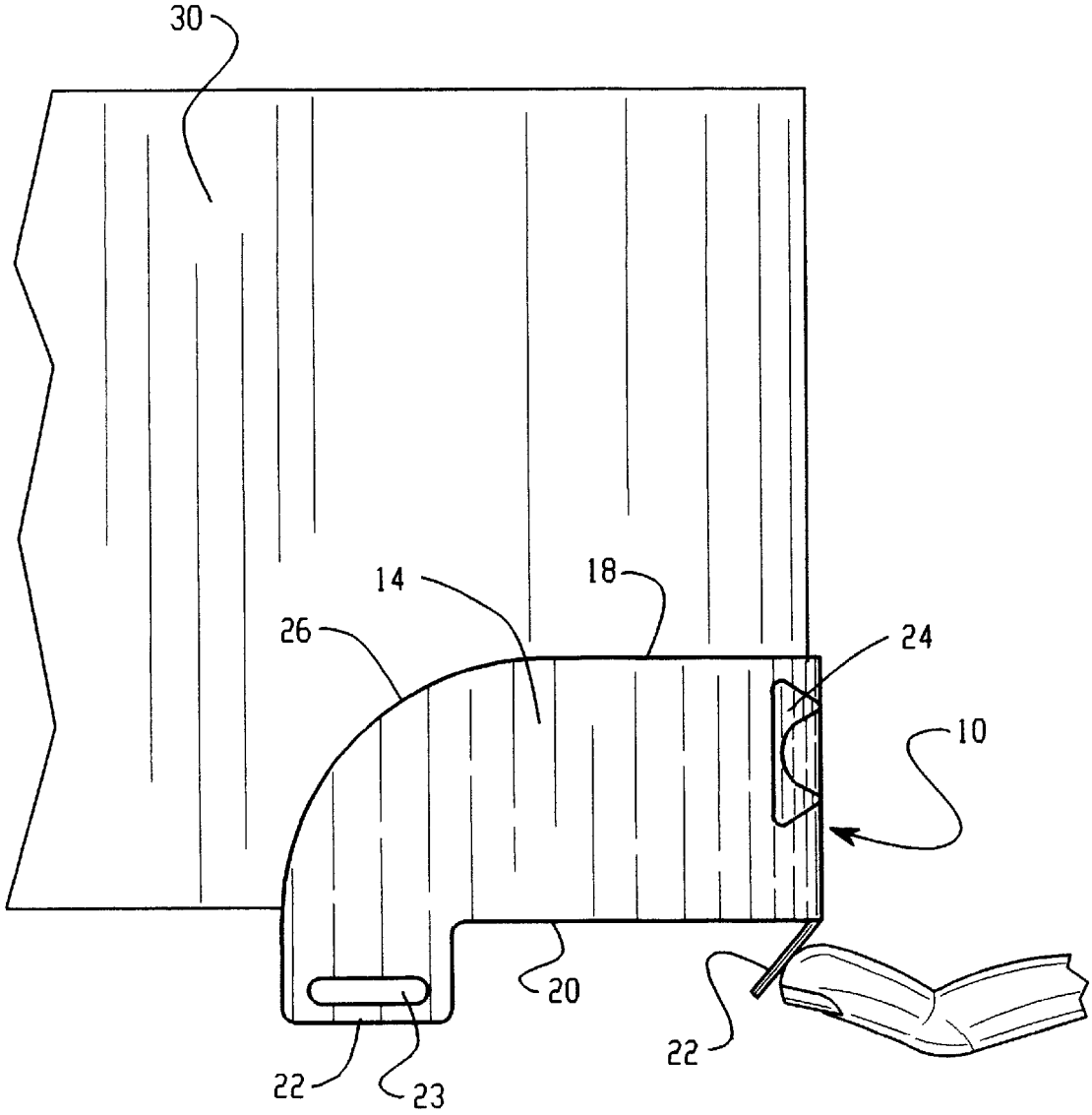
FIG. 4 is a side view of a metal mattress foundation corner guard of the present invention with the attachment tabs being formed to lie flush against the flat bottom of a mattress foundation.
Figure 5:
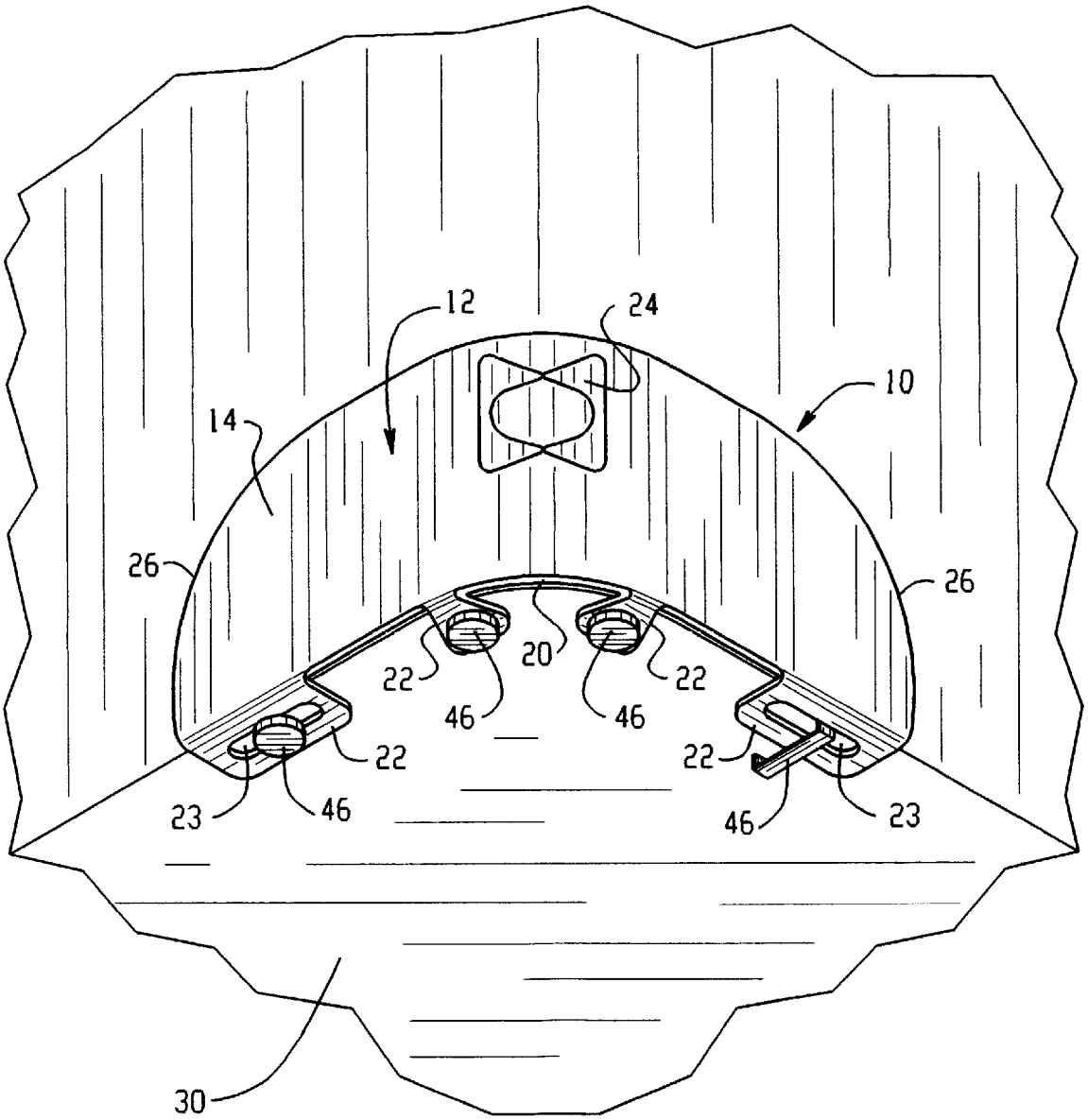
FIG. 5 is a perspective view of a metal mattress foundation corner guard of the present invention in its final formed configuration and attached to a rounded corner of a mattress foundation.

As shown in FIG. 4, once the sidewall 12 is formed, attachment tabs 22 are then bent by hand or tool about bottom edge 33 to lie flat against bottom surface 34 of mattress foundation 30 so that attachment tabs 22 are generally perpendicular to sidewall 12. Just as with the formation of sidewall 12, the tabs 22 are rigidly configured to extend perpendicularly from the sidewall to hold the sidewall in the upright position against the corner. The strength of the bend between the attachment tabs and the sidewall is superior to the molded intersection of attachment tabs in plastic guards, so that the corner guard 10 can better resist force applied to the top edge 18 of sidewall 12. Attachment tabs 22 are then secured to the bottom surface 34 of the mattress foundation using staples or screw or nail type fasteners which are driven into the foundation framework which forms bottom surface 34. Of course, the order of the steps of bending the sidewall and the attachment tabs can be reversed within the invention, such as for example by first bending the attachment tabs to be perpendicular to sidewall 12 and then forming the radiused curve in side wall 12 to fit about a rounded corner of a mattress foundation. Furthermore, although the described method of formation uses an actual mattress foundation as the object about which the guard is formed, it is well within the scope of the invention to use any type of form or die or jig against which the sidewall 12 and attachment tabs 22 are formed as shown, for example, in FIG. 3B, with the use of correspondingly shaped tools or forms 40 and 42.

The invention thus provides a method of manufacturing and forming a metal corner guard which is significantly stronger than plastic guards, and which permanently conforms to a foundation corner guard even upon detachment of one or more of the attachment tabs.

Although the invention has been described in detail with respect to a certain preferred embodiment and method, alterations and modifications of the basic concepts, forms and methods of the invention may become apparent to those skilled in the relevant arts upon reading this specification. The present invention is intended to encompass all such alterations and modifications, and is limited only by the scope of the following claims and equivalents thereto.

What is claimed is:

1. A method of manufacturing and forming a corner guard of metal for attachment to a bottom edge of a rounded corner of a mattress foundation having perpendicular vertical walls intersecting at radiused corners and having a flat bottom, the method comprising the steps of:

manufacturing a corner guard of bendable metal in a generally flat, planar configuration, said corner guard having:

a side wall having a height dimensioned to extend a distance up the vertical walls of a mattress foundation about a rounded corner, the side wall having a length sufficient to extend from a first vertical wall of a mattress foundation around a radiused corner to an intersecting second vertical wall, the side wall having a longitudinal mid-point, an inner surface, an outer surface, an upper edge, a lower edge, and attachment tabs extending from the lower edge of the sidewall in the same plane as the side wall;

positioning said inner surface of said corner guard against the rounded corner of a mattress foundation, said lower edge aligned with a bottom surface of the mattress foundation and said mid-point aligned with a mid-point of said rounded corner of said mattress foundation;

forming said side wall of said corner guard into a curve around said rounded corner of said mattress foundation, the curve having a radius of curvature approximately equal to a radius of curvature of said rounded corner of the mattress foundation; bending said attachment tabs under said bottom surface of said mattress foundation generally perpendicular to said side wall; and attaching said attachment tabs to the bottom surface of the mattress foundation against the rounded corner.

2. The method of claim 1 wherein the step of manufacturing further includes formation of raised indicia in the sidewall.

3. The method of claim 1 further comprising formation of openings in the attachment tabs.

4. A method of manufacturing and forming a mattress foundation corner guard of metal, configured for attachment to a bottom edge of a rounded corner of a mattress foundation, the method comprising the steps of:

(a) cutting a corner guard out of a flat piece of metal, the corner guard having a sidewall with an interior side and an exterior side and top and bottom edges, and attachment tabs which extend from the bottom edge of the sidewall in the same plane as the sidewall;

(b) forming the sidewall in a curve which corresponds to a rounded corner of a mattress foundation to which the corner guard is to be attached; and (c) bending the attachment tabs relative to the sidewall to extend perpendicular to the interior side of the sidewall.

5. A method of forming a mattress foundation corner guard of metal and configured to be attached to a rounded corner of a mattress foundation having a vertical wall and a generally flat bottom, the method comprising the steps of:

cutting from a generally flat piece of metal a corner guard form having a sidewall and attachment tabs which extend from an edge of the sidewall and in the same plane as the sidewall, forming a curve in the sidewall which generally conforms to a rounded corner of a mattress foundation to which the corner guard is to be attached, and forming the attachment tabs to extend generally perpendicularly from the sidewall.

* * * * *